US011359631B2

(12) United States Patent
Ignatiev et al.

(10) Patent No.: US 11,359,631 B2
(45) Date of Patent: Jun. 14, 2022

(54) CO-ROTATING SCROLL COMPRESSOR WITH BEARING ABLE TO ROLL ALONG SURFACE

(71) Applicant: Emerson Climate Technologies, Inc., Sidney, OH (US)

(72) Inventors: Kirill M. Ignatiev, Sidney, OH (US); Mikhail A. Antimonov, Beavercreek, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 17/097,478

(22) Filed: Nov. 13, 2020

(65) Prior Publication Data

US 2021/0148362 A1 May 20, 2021

Related U.S. Application Data

(60) Provisional application No. 62/936,063, filed on Nov. 15, 2019.

(51) Int. Cl.
*F04C 23/00* (2006.01)
*F04C 18/02* (2006.01)
(Continued)

(52) U.S. Cl.
CPC ..... *F04C 23/008* (2013.01); *F01C 21/02* (2013.01); *F04C 18/023* (2013.01);
(Continued)

(58) Field of Classification Search
CPC ..... F01C 1/023–0238; F04C 18/023–0238
See application file for complete search history.

(56) References Cited

U.S. PATENT DOCUMENTS 2,415,011 A 1/1947 Hubacker
2,420,124 A 5/1947 Coulson
(Continued)

FOREIGN PATENT DOCUMENTS

CN 101080597 A 11/2007
CN 101682226 A 3/2010
(Continued)

OTHER PUBLICATIONS

U.S. Appl. No. 15/425,266, filed Feb. 6, 2017, Roy J. Doepker et al.
(Continued)

*Primary Examiner* — Laert Dounis
(74) *Attorney, Agent, or Firm* — Harness, Dickey & Pierce, P.L.C.

(57) ABSTRACT

A compressor may include a shell assembly, a compression mechanism, a driveshaft, a first bearing, a second bearing, a third bearing, and a surface supporting the third bearing. The compression mechanism may include first and second compression members. The driveshaft may be coupled to the first compression member to rotate the first compression member relative to the second compression member. The first bearing may support the driveshaft for rotation about a first axis. The second bearing may support the driveshaft for rotation about the first axis. The third bearing defines a second axis. The third bearing may support the second compression member for rotation relative to the first compression member. The surface may support the third bearing such that the third bearing is able to roll along the surface to move the second compression member and the second axis in a radial direction relative to the first compression member.

20 Claims, 8 Drawing Sheets

(51) Int. Cl.

| | |
|---|---|
| ***F04C 29/02*** | (2006.01) |
| ***F04C 29/04*** | (2006.01) |
| ***F01C 21/02*** | (2006.01) |

(52) U.S. Cl.

CPC ..... *F04C 18/0207* (2013.01); *F04C 29/02* (2013.01); *F04C 29/042* (2013.01); *F04C 2240/30* (2013.01); *F04C 2240/50* (2013.01)

(56) References Cited

U.S. PATENT DOCUMENTS

| | | | | |
|---|---|---|---|---|
| 2,440,593 | A | | 4/1948 | Miller |
| 3,817,664 | A | * | 6/1974 | Bennett ..... F01C 1/0215 418/60 |
| 4,105,374 | A | | 8/1978 | Scharf |
| 4,753,582 | A | | 6/1988 | Morishita et al. |
| 4,781,550 | A | | 11/1988 | Morishita et al. |
| 4,846,639 | A | | 7/1989 | Morishita et al. |
| 4,927,339 | A | | 5/1990 | Riffe et al. |
| 4,927,340 | A | | 5/1990 | McCullough |
| 4,950,135 | A | | 8/1990 | Tojo et al. |
| 5,002,470 | A | | 3/1991 | Gormley et al. |
| 5,051,075 | A | | 9/1991 | Young |
| 5,069,605 | A | | 12/1991 | Saitoh et al. |
| 5,073,093 | A | | 12/1991 | Takagi et al. |
| 5,082,432 | A | | 1/1992 | Kikuchi |
| 5,090,876 | A | | 2/1992 | Hashizume et al. |
| 5,099,658 | A | | 3/1992 | Utter et al. |
| 5,123,818 | A | | 6/1992 | Gormley et al. |
| 5,129,798 | A | | 7/1992 | Crum et al. |
| 5,141,421 | A | | 8/1992 | Bush et al. |
| 5,142,885 | A | | 9/1992 | Utter et al. |
| 5,149,255 | A | | 9/1992 | Young |
| 5,178,526 | A | | 1/1993 | Galante et al. |
| 5,199,280 | A | | 4/1993 | Riffe et al. |
| 5,211,031 | A | | 5/1993 | Murayama et al. |
| 5,242,284 | A | | 9/1993 | Mitsunaga et al. |
| 5,256,042 | A | | 10/1993 | McCullough et al. |
| 5,256,044 | A | | 10/1993 | Nieter et al. |
| 5,263,822 | A | | 11/1993 | Fujio |
| 5,277,563 | A | | 1/1994 | Wen-Jen et al. |
| 5,314,316 | A | | 5/1994 | Shibamoto et al. |
| 5,328,341 | A | | 7/1994 | Forni |
| 5,421,709 | A | | 6/1995 | Hill et al. |
| 5,449,279 | A | | 9/1995 | Hill et al. |
| 5,490,769 | A | | 2/1996 | Calhoun |
| 5,713,731 | A | | 2/1998 | Utter et al. |
| 5,791,883 | A | | 8/1998 | Ban et al. |
| 6,359,357 | B1 | | 3/2002 | Blumenstock |
| 6,616,430 | B2 | | 9/2003 | Mori et al. |
| 6,692,205 | B2 | | 2/2004 | Moroi et al. |
| 6,712,589 | B2 | | 3/2004 | Mori et al. |
| 6,776,593 | B1 | | 8/2004 | Cho |
| 6,993,910 | B2 | | 2/2006 | Iwanami et al. |
| 7,201,567 | B2 | | 4/2007 | Wiertz et al. |
| 7,344,367 | B2 | | 3/2008 | Manole |
| 8,007,260 | B2 | | 8/2011 | Yanagisawa |
| 8,058,762 | B2 | | 11/2011 | Asano |
| 8,179,016 | B2 | | 5/2012 | Asano |
| 8,323,006 | B2 | | 12/2012 | Schofield et al. |
| 8,373,326 | B2 | | 2/2013 | Enomoto et al. |
| 8,894,388 | B2 | | 11/2014 | Lee et al. |
| 9,169,841 | B2 | | 10/2015 | Bonnefoi et al. |
| 9,534,599 | B2 | | 1/2017 | Rosson et al. |
| 10,215,174 | B2 | | 2/2019 | Stover et al. |
| 10,280,922 | B2 | | 5/2019 | Doepker et al. |
| 10,400,770 | B2 | | 9/2019 | Fullenkamp et al. |
| 10,415,567 | B2 | | 9/2019 | Doepker et al. |
| 10,465,954 | B2 | | 11/2019 | Doepker et al. |
| 10,718,330 | B2 | | 7/2020 | Stover et al. |
| 10,995,754 | B2 | | 5/2021 | Doepker et al. |
| 11,041,494 | B2 | | 6/2021 | Hirata et al. |
| 2002/0182094 | A1 | | 12/2002 | Mori et al. |
| 2005/0031465 | A1 | | 2/2005 | Dreiman et al. |
| 2005/0201884 | A1 | | 9/2005 | Dreiman |
| 2008/0087033 | A1 | | 4/2008 | Bae et al. |
| 2009/0104060 | A1 | | 4/2009 | Sato et al. |
| 2010/0164313 | A1 | | 7/2010 | Langford et al. |
| 2010/0225195 | A1 | | 9/2010 | Asano et al. |
| 2011/0002797 | A1 | | 1/2011 | Takeuchi et al. |
| 2011/0038737 | A1 | | 2/2011 | Conry et al. |
| 2012/0131945 | A1 | | 5/2012 | Huang et al. |
| 2012/0171060 | A1 | | 7/2012 | Shin et al. |
| 2013/0036762 | A1 | | 2/2013 | Shaffer et al. |
| 2013/0181565 | A1 | | 7/2013 | Petro et al. |
| 2014/0361651 | A1 | | 12/2014 | Park et al. |
| 2016/0043602 | A1 | | 2/2016 | Hosek et al. |
| 2017/0051741 | A1 | | 2/2017 | Shaffer et al. |
| 2018/0013336 | A1 | | 1/2018 | Li |
| 2018/0080446 | A1 | | 3/2018 | Choi et al. |
| 2018/0087509 | A1 | | 3/2018 | Johnson et al. |
| 2018/0223842 | A1 | | 8/2018 | Stover et al. |
| 2018/0223843 | A1 | | 8/2018 | Doepker et al. |
| 2018/0223848 | A1 | | 8/2018 | Doepker et al. |
| 2018/0223849 | A1 | | 8/2018 | Doepker et al. |
| 2018/0224171 | A1 | | 8/2018 | Doepker et al. |
| 2018/0363654 | A1 | | 12/2018 | Doepker et al. |
| 2019/0178247 | A1 | | 6/2019 | Yamashita et al. |
| 2019/0186488 | A1 | | 6/2019 | Stover et al. |
| 2020/0025199 | A1 | | 1/2020 | Wilson et al. |

FOREIGN PATENT DOCUMENTS

| | | | | |
|---|---|---|---|---|
| CN | 102480197 | A | | 5/2012 |
| CN | 103807166 | A | | 5/2014 |
| CN | 104520599 | A | | 4/2015 |
| CN | 105612351 | A | | 5/2016 |
| CN | 105971880 | A | | 9/2016 |
| CN | 208106754 | U | | 11/2018 |
| CN | 208106761 | U | | 11/2018 |
| CN | 208106763 | U | | 11/2018 |
| CN | 208138137 | U | | 11/2018 |
| EP | 0534891 | A1 | | 3/1993 |
| JP | S62210279 | A | | 9/1987 |
| JP | H02140477 | A | | 5/1990 |
| JP | H02207190 | A | | 8/1990 |
| JP | H06101659 | A | * | 4/1994 ..... F04C 18/023 |
| JP | H06213232 | A | | 8/1994 |
| JP | H0712076 | A | | 1/1995 |
| JP | H07229481 | A | | 8/1995 |
| JP | H07332260 | A | | 12/1995 |
| JP | H08121358 | A | | 5/1996 |
| JP | H08144972 | A | | 6/1996 |
| JP | 2004052657 | A | | 2/2004 |
| JP | 2012115084 | A | | 6/2012 |
| JP | 2012215092 | A | | 11/2012 |
| JP | 2015004296 | A | | 1/2015 |
| JP | 2015124653 | A | | 7/2015 |
| KR | 910001253 | A | | 1/1991 |
| KR | 20110000545 | A | | 1/2011 |
| KR | 20120069713 | A | | 6/2012 |
| KR | 20150006278 | A | | 1/2015 |
| KR | 20160091106 | A | | 8/2016 |
| KR | 20180031389 | A | | 3/2018 |
| TW | 223674 | B | | 5/1994 |
| WO | WO-2018116696 | A1 | | 6/2018 |
| WO | WO-2018134739 | A1 | | 7/2018 |

OTHER PUBLICATIONS

U.S. Appl. No. 15/877,870, filed Jan. 23, 2018, Roy J. Doepker et al.

Restriction Requirement regarding U.S. Appl. No. 15/425,266, dated May 28, 2019.

Office Action regarding U.S. Appl. No. 15/425,266, dated Oct. 8, 2019.

Hasegawa, Hiroshi et al., "Dynamic Analysis of a Co-Rotating Scroll Compressor." International Compressor Engineering Conference, Paper 1313, pp. 643-648 (1998).

McMullen, Patrick T. et al., "Combination Radial-Axial Magnetic Bearing." Seventh International Symposium on Magnetic Bearings, Zürich (Aug. 23-25, 2000).

(56) References Cited

OTHER PUBLICATIONS

Hinckley, Mark, "New Levels of Performance with Magnetic Bearings." Design World, https://www.designworldonline.com/new-levels-of-performance-with-magnetic-bearings/ (Oct. 8, 2010).
Mahmoudi, A. et al., "Axial-flux permanent-magnet machine modeling, design, simulation and analysis." Scientific Research and Essays, vol. 6, No. 12, pp. 2525-2549 (Jun. 18, 2011).
Faculty of Engineering—Electric Energy Group, "Design of Electric Machines: Axial Flux Machines." Electric Energy Magazine, No. 4, Mondragon Unibertsitatea, pp. 1-21 (Jan.-Jun. 2013).
Frank, Evan et al., "Ring Motors—Design Flexibility for Innovative Configurations." Motion Control and Automation Technology, NASA Tech Briefs, pp. 14-15 (Sep. 2014).
Office Action regarding U.S. Appl. No. 15/205,907, dated May 29, 2018.
International Search Report regarding International Application No. PCT/US2018/017069, dated Jun. 12, 2018.
Written Opinion of the International Searching Authority regarding International Application No. PCT/US2018/017069, dated Jun. 12, 2018.
Search Report regarding European Patent Application No. 18155362.9, dated Jul. 2, 2018.
Search Report regarding European Patent Application No. 18155363.7, dated Jul. 2, 2018.
Office Action regarding U.S. Appl. No. 15/425,374, dated Jul. 27, 2018.
Restriction Requirement regarding U.S. Appl. No. 15/425,428, dated Aug. 8, 2018.
Search Report regarding European Patent Application No. 18155358.7, dated Oct. 11, 2018.
Office Action regarding U.S. Appl. No. 15/425,428, dated Nov. 1, 2018.
Notice of Allowance regarding U.S. Appl. No. 15/425,374, dated Nov. 7, 2018.
Notice of Allowance regarding U.S. Appl. No. 15/425,374, dated Nov. 30, 2018.
Office Action regarding U.S. Appl. No. 16/114,912, dated Dec. 3, 2018.
Restriction Requirement regarding U.S. Appl. No. 15/425,319, dated Jan. 10, 2019.
Notice of Allowance regarding U.S. Appl. No. 15/425,428, dated Feb. 15, 2019.
Office Action regarding Korean Patent Application No. 10-2018-0013623, dated Feb. 18, 2019. Translation provided by KS KORYO International IP Law Firm.
Office Action regarding Chinese Patent Application No. 201810116198.8, dated Feb. 26, 2019. Translation provided by Unitalen Attorneys at Law.
Office Action regarding Korean Patent Application No. 10-2018-0013620, dated Feb. 26, 2019. Translation provided by KS KORYO International IP Law Firm.
Office Action regarding Chinese Patent Application No. 201810119087.2, dated Feb. 27, 2019. Translation provided by Unitalen Attorneys at Law.
Office Action regarding Chinese Patent Application No. 201810118025.X, dated Mar. 4, 2019. Translation provided by Unitalen Attorneys at Law.
Office Action regarding Korean Patent Application No. 10-2018-0013622, dated Mar. 20, 2019. Translation provided by KS KORYO International IP Law Firm.
Office Action regarding Chinese Patent Application No. 201810119178.6, dated Mar. 21, 2019. Translation provided by Unitalen Attorneys at Law.
Office Action regarding Korean Patent Application No. 10-2018-0013621, dated Mar. 25, 2019. Translation provided by KS KORYO International IP Law Firm.
Office Action regarding U.S. Appl. No. 16/114,912, dated Mar. 28, 2019.
Office Action regarding U.S. Appl. No. 15/425,319, dated Apr. 1, 2019.
Office Action regarding Korean Patent Application No. 10-2018-0013620, dated May 28, 2019. Translation provided by Ks Koryo International IP Law Firm.
Restriction Reguirement regarding U.S. Appl. No. 15/425,266, dated May 28, 2019.
Notice of Allowance regarding U.S. Appl. No. 16/114,912, dated Jun. 10, 2019.
Office Action regarding Korean Patent Application No. 10-2018-0013622, dated Jun. 26, 2019. Translation provided by KS KORYO International IP Law Firm.
Office Action regarding U.S. Appl. No. 16/284,653, dated Jul. 29, 2019.
Notice of Allowance regarding U.S. Appl. No. 15/425,319, dated Aug. 7, 2019.
Office Action regarding U.S. Appl. No. 15/205,907, dated Aug. 9, 2019.
Office Action regarding Chinese Patent Application No. 201810116198.8, dated Aug. 26, 2019. Translation provided by Unitalen Attorneys at Law.
Office Action regarding Chinese Patent Application No. 201810118025.X, dated Aug. 28, 2019. Translation provided by Unitalen Attorneys at Law.
Office Action regarding Indian Patent Application No. 201824003471, dated Sep. 11, 2019.
Office Action regarding Mexican Patent Application No. MX/a/2017/008998, dated Oct. 1, 2019. Translation provided by Panamericana de Patentes y Marcas, S.C.
Office Action regarding U.S. Appl. No. 15/425,266, dated Oct. 18, 2019.
Office Action regarding Chinese Patent Application No. 201810119178.6, dated Oct. 18, 2019. Translation provided by Unitalen Attorneys at Law.
Office Action regarding Chinese Patent Application No. 201810118025.X, dated Feb. 25, 2020. Translation provided by Unitalen Attorneys at Law.
Notice of Allowance regarding U.S. Appl. No. 16/284,653, dated Mar. 12, 2020.
Office Action regarding U.S. Appl. No. 15/425,266, dated Apr. 3, 2020.
Office Action regarding U.S. Appl. No. 15/877,870, dated Apr. 13, 2020.
Office Action regarding Chinese Patent Application No. 201880016172.4, dated Jul. 1, 2020. Translation provided by Unitalen Attorneys at Law.
Office Action regarding Chinese Patent Application No. 201710551365.7, dated Jul. 3, 2020. Summary translation provided by Zhongzi Law Office.
Office Action regarding U.S. Appl. No. 15/425,266, dated Jul. 6, 2020.
Office Action regarding U.S. Appl. No. 15/425,266, dated Aug. 28, 2020.
Office Action regarding European Patent Application No. 18155362.9, dated Oct. 2, 2020.
Office Action regarding European Patent Application No. 18155358.7, dated Oct. 6, 2020.
Office Action regarding European Patent Application No. 18155363.7, dated Oct. 7, 2020.
Ex Parte Quayle Action regarding U.S. Appl. No. 15/877,870, dated Oct. 19, 2020.
Office Action regarding Korean Patent Application No. 10-2019-7023591, dated Oct. 19, 2020. Translation provided by Y.S. Chang & Associates.
Notice of Allowance regarding U.S. Appl. No. 15/877,870, dated Jan. 28, 2021.
Office Action regarding U.S. Appl. No. 15/425,266, dated Feb. 10, 2021.
Office Action regarding Chinese Patent Application No. 201880016172.4, dated Feb. 26, 2021. Translation provided by Unitalen Attorneys at Law.
International Search Report regarding International Application No. PCT/US2020/060527, dated Mar. 5, 2021.

(56) References Cited

OTHER PUBLICATIONS

Written Opinion of the International Searching Authority regarding International Application No. PCT/US2020/060527, dated Mar. 5, 2021.
Notice of Allowance regarding U.S. Appl. No. 15/425,266 dated May 19, 2021.
Supplemental Notice of Allowability regarding U.S. Appl. No. 15/425,266 dated May 27, 2021.
Search Report regarding European Patent Application No. 21186670.2, dated Oct. 26, 2021.
U.S. Appl. No. 17/519,721, filed Nov. 5, 2021, Kirill M. Ignatiev.
U.S. Appl. No. 17/519,876, filed Nov. 5, 2021, Kirill M. Ignatiev.
U.S. Appl. No. 17/519,953, filed Nov. 5, 2021, Kirill M. Ignatiev.

* cited by examiner

CO-ROTATING SCROLL COMPRESSOR WITH BEARING ABLE TO ROLL ALONG SURFACE

CROSS-REFERENCE TO RELATED APPLICATIONS

This application claims the benefit of U.S. Provisional Application No. 62/936,063, filed on Nov. 15, 2019. The entire disclosure of the above application is incorporated herein by reference.

FIELD

The present disclosure relates to a compressor, and more particularly, to a co-rotating scroll compressor.

BACKGROUND

This section provides background information related to the present disclosure and is not necessarily prior art.

A climate-control system (e.g., a heat-pump system, an air-conditioning system, a refrigeration system, etc.) may include a fluid circuit having an outdoor heat exchanger, an indoor heat exchanger, an expansion device disposed between the indoor and outdoor heat exchangers, and a compressor circulating a working fluid between the indoor and outdoor heat exchangers. Efficient and reliable operation of the compressor is desirable to ensure that the climate-control system in which the compressor is installed is capable of effectively and efficiently providing a cooling and/or heating effect on demand.

SUMMARY

This section provides a general summary of the disclosure and is not a comprehensive disclosure of its full scope or all of its features.

The present disclosure provides a compressor that may include a shell assembly, a compression mechanism, a driveshaft, a first bearing, a second bearing, a third bearing, and a surface supporting the third bearing. The compression mechanism is disposed within the shell assembly and may include a first compression member and a second compression member that cooperate to form one or more compression pockets therebetween. The driveshaft may be coupled to the first compression member and configured to rotate the first compression member and the second compression member. The first bearing may support the driveshaft for rotation about a first axis. The second bearing may be spaced apart from the first bearing and may support the driveshaft for rotation about the first axis. The third bearing may be spaced apart from the first and second bearings and may define a second axis. The third bearing may support the second compression member for rotation about the second axis. The surface may support the third bearing relative to the shell assembly such that the entire third bearing (i.e., both the inner and outer rings of the third bearing) is able to roll along the surface to move the second compression member and the second axis in a radial direction (i.e., a direction from the first axis to the second axis) relative to the first compression member.

In some configurations of the compressor of the above paragraph, the surface is fixed relative to the shell assembly.

In some configurations of the compressor of either of the above paragraphs, the surface is integrally formed with the shell assembly.

In some configurations of the compressor of any of the above paragraphs, the surface is a flat surface.

In some configurations of the compressor of any of the above paragraphs, the surface supports an outer periphery (i.e., an outer diametrical surface) of the third bearing such that the outer periphery is in rolling contact with the surface.

In some configurations of the compressor of any of the above paragraphs, the surface is a round surface (e.g., a cylindrical surface).

In some configurations of the compressor of any of the above paragraphs, the surface supports an inner periphery (i.e., an inner diametrical surface) of the third bearing such that the inner periphery is in rolling contact with the surface.

In some configurations of the compressor of any of the above paragraphs, the surface defines a third axis that is parallel to and spaced apart from the second axis.

In some configurations of the compressor of any of the above paragraphs, the first compression member includes an outer hub that surrounds the second compression member.

In some configurations of the compressor of any of the above paragraphs, the outer hub is attached to the driveshaft (e.g., by a coupling).

In some configurations of the compressor of any of the above paragraphs, the driveshaft includes a discharge passage through which compressed working fluid is transmitted from the compression mechanism to a discharge chamber defined by the shell assembly.

In some configurations of the compressor of any of the above paragraphs, the first and second compression members are scroll members having intermeshing spiral wraps.

The present disclosure also provides a compressor that may include a shell assembly, a first scroll member, a second scroll member, a driveshaft, a first bearing, a scroll bearing, and a surface supporting the scroll bearing. The first scroll member may be disposed within the shell assembly and may be rotatable relative to the shell assembly about a first axis. The second scroll member may be disposed within the shell assembly and may be rotatable relative to the shell assembly about a second axis that is parallel to and spaced apart from the first axis. The first and second scroll members cooperate to form one or more compression pockets therebetween. The driveshaft may be coupled to the first scroll member and may be configured to rotate the first scroll member about the first axis. The first bearing may support the driveshaft for rotation about the first axis. The scroll bearing may be spaced apart from the first bearing and may define the second axis. The scroll bearing may support the second scroll member for rotation relative to the first scroll member about the second axis. The surface may support the scroll bearing relative to the shell assembly such that the entire scroll bearing (i.e., both the inner and outer rings of the scroll bearing) is able to roll along the surface to move the second scroll member and the second axis in a radial direction (i.e., a direction perpendicular to the first and second axes) relative to the first scroll member.

In some configurations of the compressor of the above paragraph, the surface is fixed relative to the shell assembly.

In some configurations of the compressor of either of the above paragraphs, the surface is integrally formed with the shell assembly.

In some configurations of the compressor of any of the above paragraphs, the surface is a flat surface.

In some configurations of the compressor of any of the above paragraphs, the surface supports an outer periphery (i.e., an outer diametrical surface) of the scroll bearing such that the outer periphery is in rolling contact with the surface.

In some configurations of the compressor of any of the above paragraphs, the surface is a round surface (e.g., a cylindrical surface).

In some configurations of the compressor of any of the above paragraphs, the surface supports an inner periphery (i.e., an inner diametrical surface) of the scroll bearing such that the inner periphery is in rolling contact with the surface.

In some configurations of the compressor of any of the above paragraphs, the surface defines a third axis that is parallel to and spaced apart from the second axis.

In some configurations of the compressor of any of the above paragraphs, the first scroll member includes an outer hub that surrounds the second scroll member.

In some configurations of the compressor of any of the above paragraphs, the outer hub is attached to the driveshaft (e.g., by a coupling).

In some configurations of the compressor of any of the above paragraphs, the driveshaft includes a discharge passage through which compressed working fluid is transmitted to a discharge chamber defined by the shell assembly.

In some configurations, the compressor of any of the above paragraphs may include another bearing spaced apart from the first bearing and supporting the driveshaft for rotation about the first axis.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
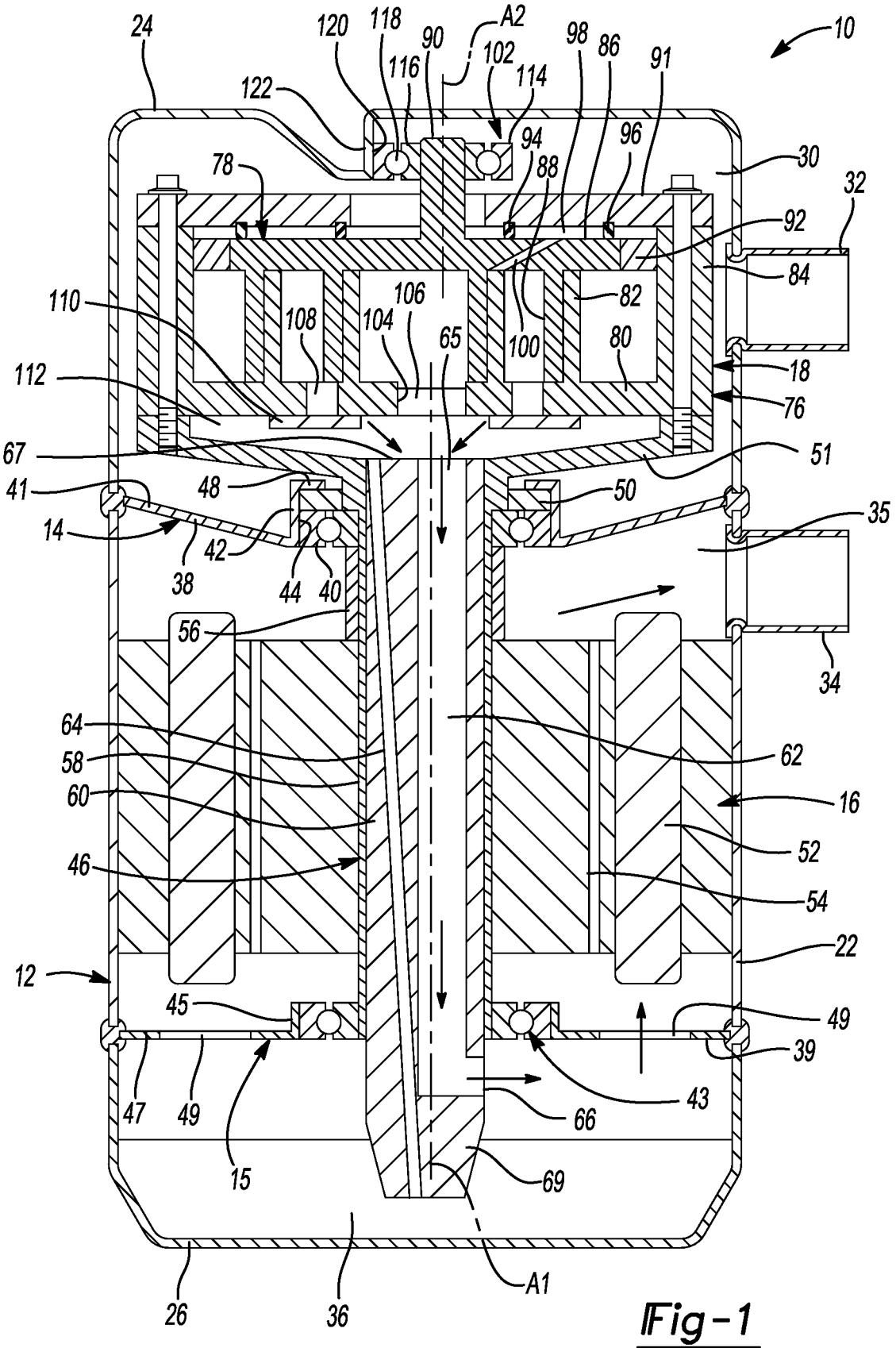
FIG. 1 is a cross-sectional view of a compressor according to the principles of the present disclosure.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided that may include a hermetic shell assembly 12, a first bearing housing assembly 14, a second bearing housing assembly 15, a motor assembly 16, and a compression mechanism 18.

The shell assembly 12 may generally form a compressor housing and may include a cylindrical shell 22, a first end cap 24 at one end of the shell 22, and a second end cap (or base) 26 at another end of the shell 22. The first end cap 24 and the first bearing housing assembly 14 may cooperate to define a suction chamber 30. A suction gas inlet fitting 32 may be attached to the shell assembly 12 at an opening in the first end cap 24 or in the shell 22. Suction-pressure working fluid (i.e., low-pressure working fluid) may enter the suction chamber 30 through the suction gas inlet fitting 32 and may be drawn into the compression mechanism 18 for compression therein.

A discharge gas outlet fitting 34 may be attached to the shell assembly 12 at another opening and may communicate with a discharge chamber 35 defined by the shell 22 and the first bearing housing assembly 14. Discharge-pressure working fluid (i.e., working fluid at a higher pressure than suction pressure) may be discharged by the compression mechanism 18 and may flow into the discharge chamber 35. The discharge-pressure working fluid in the discharge chamber 35 may exit the compressor 10 through the discharge gas outlet fitting 34. In some configurations, a discharge valve (e.g., a check valve) may be disposed within or adjacent the discharge gas outlet fitting 34 and may allow fluid to exit the discharge chamber 35 through the discharge gas outlet fitting 34 and prevent fluid from entering the discharge chamber 35 through the discharge gas outlet fitting 34.

The second end cap 26 of the shell assembly 12 may define a lubricant sump 36 that contains a volume of lubricant that can be pumped throughout the compressor 10. The lubricant sump 36 is a high-side sump—i.e., the sump 36 is disposed within the discharge chamber 35.

The first bearing housing assembly 14 may be affixed to the shell 22 and may include a first bearing housing 38 and a first bearing 40. The first bearing 40 may be a rolling element bearing or any other suitable type of bearing. The first bearing housing 38 may house the first bearing 40 therein and may separate the suction chamber 30 from the discharge chamber 35 (i.e., the first bearing housing 38 forms a partition preventing fluid communication between the suction chamber 30 and the discharge chamber 35). The first bearing housing 38 may be a plate or membrane that can be stamped, machined, cast or otherwise formed from a metallic material (e.g., steel, iron, or aluminum) or any other suitable material. An outer periphery of the first bearing housing 38 may be welded or otherwise sealingly attached to the shell 22. The first bearing housing 38 may include an annular central hub 42 that extends axially (i.e., in a direction along or parallel to a rotational axis A1 of driveshaft 46) from a main body 41 of the first bearing housing 38. The hub 42 defines a central aperture 44 in which the first bearing 40 may be received and through which the driveshaft 46 may extend. An axial end of the hub 42 may include a flange 48 that extends radially inward toward the rotational axis A1 of the driveshaft 46. An annular seal 50 may be disposed within the central aperture 44 between the flange 48 and the first bearing 40. The seal 50 sealingly engages the first bearing housing 38 and the driveshaft 46 or a coupling 51 attached to the driveshaft 46. The seal 50 restricts fluid communication between the suction chamber 30 and the discharge chamber 35.

The second bearing housing assembly 15 may be affixed to the shell 22 and may include a second bearing housing 39 and a second bearing 43. The second bearing housing 39 may house the second bearing 43 therein. The second bearing 43 may be a rolling element bearing or any other suitable type of bearing. The second bearing housing 39 may be a plate or membrane that can be stamped, machined, cast or otherwise formed from a metallic material (e.g., steel, iron, or aluminum) or any other suitable material. An outer periphery of the second bearing housing 39 may be welded or otherwise sealingly attached to the shell 22. The second bearing housing 39 may include an annular central hub 45 in which the second bearing 43 may be received and through which the driveshaft 46 may extend. A main body 47 of the second bearing housing 39 may include one or more openings 49 through which discharge-pressure working fluid can flow throughout the discharge chamber 35.

The motor assembly 16 may be disposed within the discharge chamber 35 and may include a motor stator 52 and a rotor 54. The motor stator 52 may be attached to the shell 22 (e.g., via press fit, staking, and/or welding). The rotor 54 may be attached to the driveshaft 46 (e.g., via press fit, staking, and/or welding). The driveshaft 46 may be driven by the rotor 54 and may be supported by the first and second bearings 40, 43 for rotation relative to the shell assembly 12. A spacer 56 (e.g., a tubular member) may encircle the driveshaft 46 and may be disposed axially between the rotor 54 and the first bearing 40 such that the spacer 56 may be axially supported by the rotor 54 and may axially support the first bearing 40. In some configurations, the motor assembly 16 is a variable-speed motor. In other configurations, the motor assembly 16 could be a multi-speed motor or a fixed-speed motor.

The driveshaft 46 may include an outer tubular sleeve 58 and a generally cylindrical inner insert 60 disposed within the sleeve 58. The insert 60 may include a discharge passage 62 and a lubricant passage 64. The discharge passage 62 provides fluid communication between the compression mechanism 18 and the discharge chamber 35. An inlet 65 of the discharge passage 62 may be disposed at or near a first end 67 of the driveshaft 46 adjacent the compression mechanism 18. An outlet 66 of the discharge passage 62 is open to the discharge chamber 35. In the particular configuration shown in FIG. 1, the outlet 66 is disposed between the second bearing housing 39 and the lubricant sump 36. Discharge gas that exits the discharge passage 62 through the outlet 66 may flow through the openings 49 in the second bearing housing 39 and may flow through and/or around the motor assembly 16 to cool the motor assembly 16 before exiting the compressor 10 through the discharge gas outlet fitting 34. In addition to directing compressed working fluid from the compression mechanism 18 to the discharge chamber 35, the discharge passage 62 may also function as a rotating oil separator that separates lubricant from the working fluid. Separated lubricant may drain out of the outlet 66 of the discharge passage 62 and fall into the lubricant sump 36.

The lubricant passage 64 may extend through the first end 67 of the driveshaft 46 and a second end 69 of the driveshaft 46. The lubricant passage 64 may extend at a non-perpendicular angle relative to the rotational axis A1 of the driveshaft 46. Some or all of the second end 69 of the driveshaft 46 may be disposed at or below the lubricant level of the lubricant sump 36 such that lubricant can be drawn through the lubricant passage 64 toward the compression mechanism 18 during rotation of the driveshaft 46. Radially extending passages (not shown) may extend outward from the lubricant passage 64 to provide lubricant to the first and second bearings 40, 43.

The compression mechanism 18 may be disposed within the suction chamber 30. The compression mechanism 18 may include a first compression member and a second compression member that cooperate to define fluid pockets (i.e., compression pockets) therebetween. For example, the compression mechanism 18 may be a co-rotating scroll compression mechanism in which the first compression member is a first scroll member (i.e., a driver scroll member) 76 and the second compression member is a second scroll member (i.e., a driven scroll member) 78. In other configurations, the compression mechanism 18 could be another type of compression mechanism, such as an orbiting scroll compression mechanism, a rotary compression mechanism, a screw compression mechanism, a Wankel compression mechanism or a reciprocating compression mechanism, for example.

The first scroll member 76 may include a first end plate 80, a first spiral wrap 82 extending from the first end plate 80, and an annular outer hub 84 extending from the first end plate 80 and surrounding the first spiral wrap 82. The second scroll member 78 may include a second end plate 86, a second spiral wrap 88 extending from one side of the second end plate 86, and a cylindrical pin or hub 90 extending from the opposite side of the second end plate 86. One axial end of the outer hub 84 of the first scroll member 76 may be fixedly attached to the coupling 51 (which is fixedly attached to the driveshaft 46) and the other axial end of the outer hub 84 may be fixedly attached to an annular plate 91 that extends radially inward from the hub 84. In this manner, rotation of the driveshaft 46 causes corresponding rotation of the first scroll member 76 about the rotational axis A1 of the driveshaft 46.

The hub 90 of the second scroll member 78 is rotatably supported by a third bearing 102 (a scroll bearing). The third bearing 102 defines a second rotational axis A2 that is parallel to the rotational axis A1 and offset from the rotational axis A1.

The first and second scroll members 76, 78 may be coupled to each other by an Oldham coupling 92 or another type of coupling device or mechanism. In the example shown in FIG. 1, the Oldham coupling 92 is coupled to the outer hub 84 and to the second end plate 86. The Oldham coupling 92 causes the second scroll member 78 to rotate about the second rotational axis A2 while the first scroll member 76 rotates about the rotational axis A1.

The first and second spiral wraps 82, 88 are intermeshed with each other and cooperate to form a plurality of fluid pockets (i.e., compression pockets) therebetween. Rotation of the first scroll member 76 about the rotational axis A1 and rotation of the second scroll member 78 about the second rotational axis A2 causes the fluid pockets to decrease in size as they move from a radially outer position to a radially inner position, thereby compressing the working fluid therein from the suction pressure to the discharge pressure.

The second end plate 86 may be disposed axially between the first end plate 80 and the annular plate 91. A first annular seal 94 and a second annular seal 96 may be attached to the annular plate 91 and may sealingly and slidably engage the second end plate 86 to form an annular biasing chamber 98 between the annular plate 91 and the second end plate 86. The first and second annular seals 94, 96 keep the biasing chamber 98 sealed off from the suction chamber 30 while still allowing relative movement between the first and second scroll members 76, 78. The second end plate 86 may include a biasing passage 100 that provides fluid communication between an intermediate-pressure compression pocket and the biasing chamber 98. In some configurations, instead of the first and second annular seals 94, 96 being attached to the annular plate 91 and slidably engaging the second end plate 86, the first and second annular seals 94, 96 could be attached to the second end plate 86 and slidably engaging the annular plate 91.

The first end plate 80 or the outer hub 84 may include a suction inlet opening (not shown) through which suction-pressure working fluid from the suction chamber 30 can be drawn into the compression mechanism 18. The first scroll member 76 may also include a discharge passage 104 that extends through the first end plate 80 and provides fluid communication between a radially innermost one of the fluid pockets and the discharge passage 62 of the driveshaft 46. A discharge valve 106 (e.g., a reed valve or other check valve) may be disposed within or adjacent the discharge passage 104. The discharge valve 106 allows working fluid to be discharged from the compression mechanism 18 through the discharge passage 104 and into the discharge passage 62 and prevents working fluid in the discharge passage 62 from flowing back into to the compression mechanism 18.

In some configurations, the first end plate 80 may include variable-volume-ratio (VVR) ports 108 and VVR valves 110 (e.g., reed valves or other check valves). The VVR valves 110 allow selective venting of radially intermediate fluid pockets to the discharge passage 62 when pressures within the radially intermediate fluid pockets rise above discharge pressure (i.e., the pressure of fluid within the discharge chamber 35).

The coupling 51 and the first end plate 80 cooperate to define a chamber 112 that is fluidly separated from the suction chamber 30. That is, the seal 50 being in sealing contact with the first bearing housing 38 and the coupling 51 (or driveshaft 46) prevents fluid communication between the chamber 112 and the suction chamber 30. During rotation of the driveshaft 46, lubricant from the lubricant sump 36 may be drawn through the lubricant passage 64 in the driveshaft 46 and may flow into the chamber 112. Centrifugal force may cause the lubricant to collect in a radially outer portion of the chamber 112. Oil passages (not shown) in the first scroll member 76 and/or in the second scroll member 78 may direct lubricant from the chamber 112 to the Oldham coupling 92 and other parts of the scroll members 76, 78 that are subjected to friction.

As described above, the third bearing 102 supports the second scroll member 78 for rotation about the second rotational axis A2. The third bearing 102 may be a rolling element bearing having an outer ring 114, an inner ring 116, and a plurality of rolling elements (e.g., spheres) 118 disposed between the outer and inner rings 114, 116. The inner ring 116 may be fixedly attached to the hub 90. The rolling elements 118 are encased between the outer and inner rings 114, 116. An outer diametrical surface of the outer ring 114 may be supported by a stationary surface or shelf 120. The stationary surface 120 may be a surface (e.g., a flat surface) of a protrusion 122 attached to or integrally formed with the first end cap 24 and extending toward the compression mechanism 18.

Figure 2:
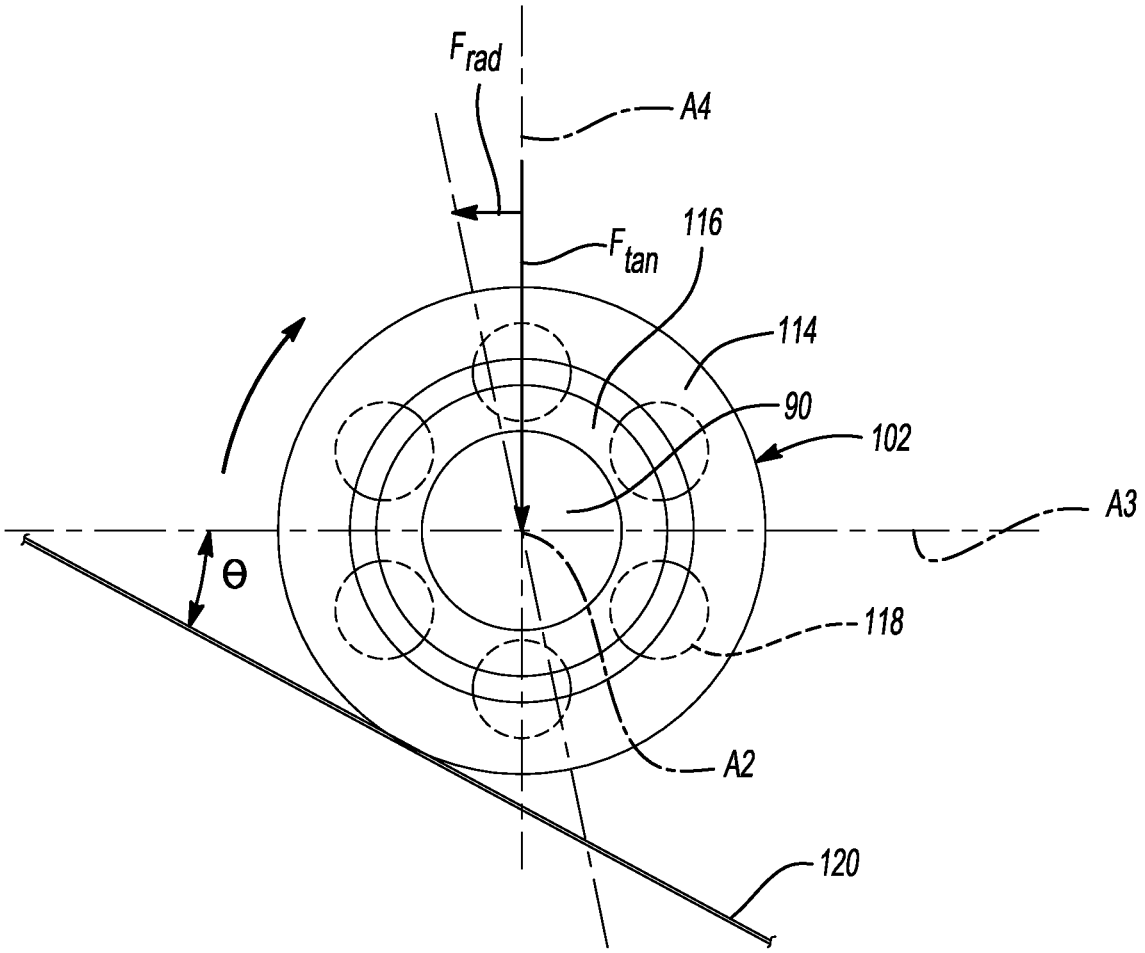
FIG. 2 is a plan view of a bearing and hub of a scroll of the compressor of FIG. 1.

As shown in FIG. 2, the stationary surface 120 may be disposed at an angle θ relative to a third axis A3. As an example (for a given compressor and a given operating envelope), the angle θ could be approximately 12 degrees. The third axis A3 may be perpendicular to the second rotational axis A2 and intersect the second rotational axis A2. The third axis A3 may be perpendicular to a fourth axis A4. The fourth axis A4 may be perpendicular to the second rotational axis A2 and intersect the second rotational axis A2. The fourth axis A4 may extend in a direction along which a tangential gas force $F_{tan}$ (i.e., a compression resistance force) acts. The direction and magnitude of the gas tangential gas force $F_{tan}$ and a radial gas force $F_{rad}$ (i.e., a force perpendicular to the tangential gas force $F_{tan}$ and parallel to the third axis A3) can be measured or calculated according to known methods for a given compressor at a given operating speed.

The angle θ of the stationary surface 120 relative to the third axis A3 can be determined experimentally or calculated according to the following equation:

$$\theta=\text{Arctan}(\text{MAX}(F_{rad}/F_{tan})+Z),$$

where: $\text{MAX}(F_{rad}/F_{tan})$ is a value of the maximum radial gas force $F_{rad}$ divided by the maximum tangential gas force $F_{tan}$ for a given compressor within a given operational envelope of the compressor; and Z is a factor of safety, which can be any desired number. For example, the factor of safety Z could be 0.05. In some embodiments, the above equation could be modified by multiplying $\text{MAX}(F_{rad}/F_{tan})$ by the factor of safety Z (rather than adding the factor of safety Z to $\text{MAX}(F_{rad}/F_{tan})$).

By supporting the outer diametrical surface of the outer ring 114 against the flat stationary surface 120, the outer ring 114 can roll along the stationary surface 120 to allow radial compliance of the second scroll member 78 (i.e., radial movement of the second scroll member 78 relative to the first scroll member 76).

Figure 3:
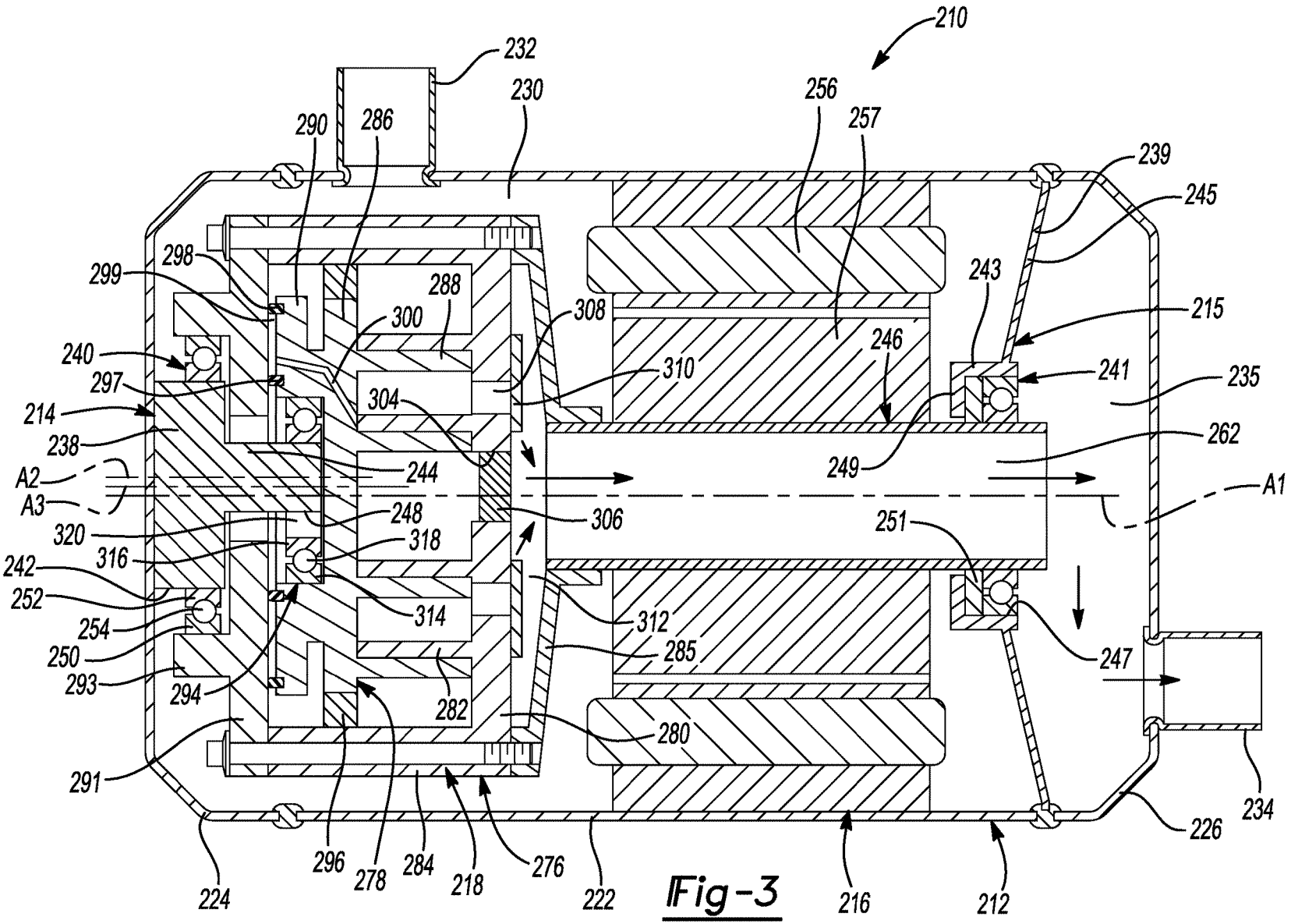
FIG. 3 is a cross-sectional view of another compressor according to the principles of the present disclosure.
Figure 4:
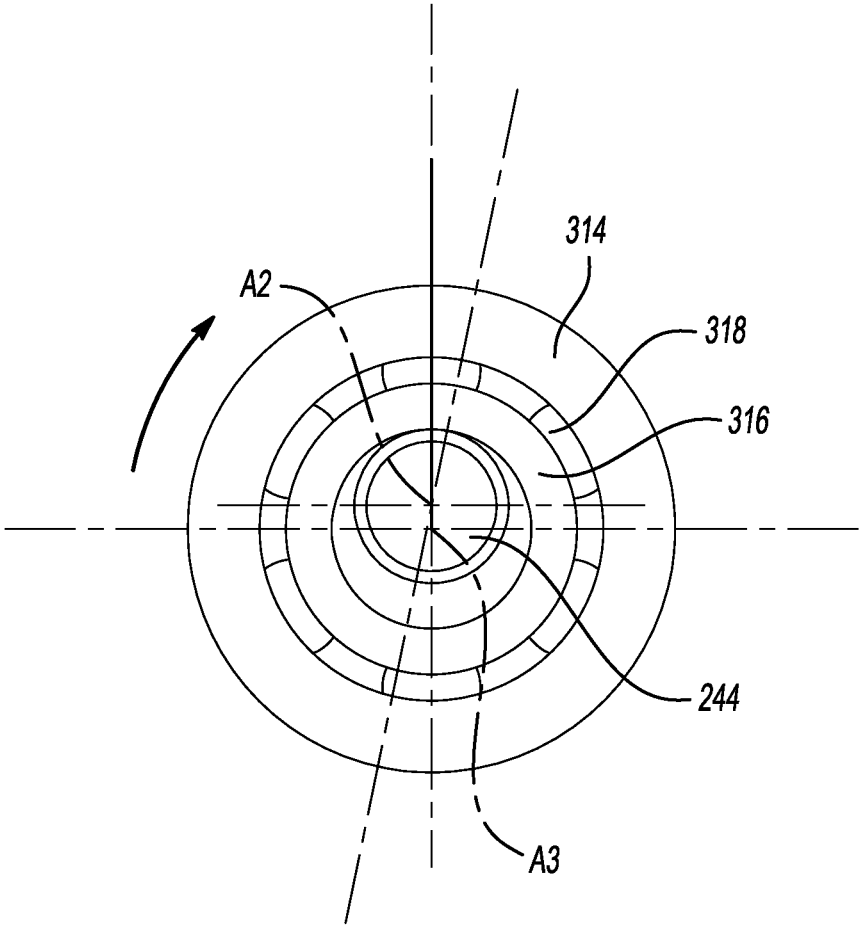
FIG. 4 is a plan view of a bearing and hub of a scroll of the compressor of FIG. 3.

With reference to FIG. 3, another compressor 210 is provided that may include a hermetic shell assembly 212, a first bearing support assembly (or bearing housing assembly) 214, a second bearing support assembly (or bearing housing assembly) 215, a motor assembly 216, and a compression mechanism 218.

The shell assembly 212 may generally form a compressor housing and may include a cylindrical shell 222, a first end cap 224 at one end of the shell 222, and a second end cap (or base) 226 at another end of the shell 222. The first end cap 224 and the shell 222 may cooperate to define a suction chamber 230. A suction gas inlet fitting 232 may be attached to the shell assembly 212 at an opening in the first end cap 224 or in the shell 222. Suction-pressure working fluid (i.e., low-pressure working fluid) may enter the suction chamber 230 through the suction gas inlet fitting 232 and may be drawn into the compression mechanism 218 for compression therein.

A discharge gas outlet fitting 234 may be attached to the second end cap 226 at another opening and may communicate with a discharge chamber 235 defined by the second end cap 226 and the second bearing support assembly 215. Discharge-pressure working fluid (i.e., working fluid at a higher pressure than suction pressure) may be discharged by the compression mechanism 218 and may flow into the discharge chamber 235. The discharge-pressure working fluid in the discharge chamber 235 may exit the compressor 210 through the discharge gas outlet fitting 234. In some configurations, a discharge valve (e.g., a check valve) may be disposed within or adjacent the discharge gas outlet fitting 234 and may allow fluid to exit the discharge chamber 235 through the discharge gas outlet fitting 234 and prevent fluid from entering the discharge chamber 235 through the discharge gas outlet fitting 234.

The first bearing support assembly 214 may include a first bearing support member 238 and a first bearing 240. The first bearing support member 238 may be fixed to or integrally formed with the shell assembly 212 (e.g., the first end cap 224) and may include a first generally cylindrical surface 242 and an eccentric pin 244. The first surface 242 and the second bearing support assembly 215 define a first rotational axis A1, which is the rotational axis of driveshaft 246. The eccentric pin 244 includes a second generally cylindrical surface 248 that defines a second axis A2 that is parallel to and offset from the first rotational axis A1.

The first bearing 240 may be a rolling element bearing having an outer ring 250, an inner ring 252, and a plurality of rolling elements (e.g., spheres) 254 disposed between the outer and inner rings 250, 252. The inner ring 252 may be fixedly attached to the first surface 242 of the first bearing support member 238. The outer ring 250 may be attached to the compression mechanism 218 (as will be described in more detail below). The rolling elements 254 are encased between the outer and inner rings 250, 252.

The second bearing support assembly 215 may be affixed to the shell assembly 212 (e.g., to the second end cap 226 and/or to the shell 222) and may include a second bearing support member (or bearing housing) 239 and a second bearing 241. The second bearing 241 may be a rolling element bearing or any other suitable type of bearing. The second bearing support member 239 may house the second bearing 241 therein and may separate the suction chamber 230 from the discharge chamber 235 (i.e., the second bearing support member 239 forms a partition preventing fluid communication between the suction chamber 230 and the discharge chamber 235). The second bearing support member 239 may be a plate or membrane that can be stamped, machined, cast or otherwise formed from a metallic material (e.g., steel, iron, or aluminum) or any other suitable material. An outer periphery of the second bearing support member 239 may be welded or otherwise sealingly attached to the second end cap 226 and/or the shell 222. The second bearing support member 239 may include an annular central hub 243 that extends axially (i.e., in a direction along or parallel to the first rotational axis A1) from a main body 245 of the second bearing support member 239. The hub 243 defines a central aperture 247 in which the second bearing 241 may be received and through which the driveshaft 246 may extend. An axial end of the hub 243 may include a flange 249 that extends radially inward toward the first rotational axis A1. An annular seal 251 may be disposed within the central aperture 247 between the flange 249 and the second bearing 241. The seal 251 sealingly engages the second bearing support member 239 and the driveshaft 246. The seal 251 restricts fluid communication between the suction chamber 230 and the discharge chamber 235.

The motor assembly 216 may be disposed within the suction chamber 230 and may include a motor stator 256 and a rotor 257. The motor stator 256 may be attached to the shell 222 (e.g., via press fit, staking, and/or welding). The rotor 257 may be attached to the driveshaft 246 (e.g., via press fit, staking, and/or welding). The driveshaft 246 may be driven by the rotor 257 and may be supported by the first and second bearings 240, 241 for rotation relative to the shell assembly 212. In some configurations, the motor assembly 216 is a variable-speed motor. In other configurations, the motor assembly 216 could be a multi-speed motor or a fixed-speed motor.

The driveshaft 246 may be a tubular sleeve defining a discharge passage 262. The discharge passage 262 may extend through opposing axial ends of the driveshaft 246 and provides fluid communication between the compression mechanism 218 and the discharge chamber 235.

The compression mechanism 218 may be disposed within the suction chamber 230. The compression mechanism 218 may include a first compression member and a second compression member that cooperate to define fluid pockets (i.e., compression pockets) therebetween. For example, the compression mechanism 218 may be a co-rotating scroll compression mechanism in which the first compression member is a first scroll member (i.e., a driver scroll member) 276 and the second compression member is a second scroll member (i.e., a driven scroll member) 278. In other configurations, the compression mechanism 218 could be another type of compression mechanism, such as a rotary compression mechanism or a Wankel compression mechanism, for example.

The first scroll member 276 may include a first end plate 280, a first spiral wrap 282 extending from the first end plate 280, and an annular outer hub 284 extending from the first end plate 280 and surrounding the first spiral wrap 282. The second scroll member 278 may include a second end plate 286, a second spiral wrap 288 extending from one side of the second end plate 286, and a hub 290 extending from the opposite side of the second end plate 286. One axial end of the outer hub 284 of the first scroll member 276 may be fixedly attached to a coupling 285 (which is fixedly attached to the driveshaft 246) and the other axial end of the outer hub 284 may be fixedly attached to an annular plate 291 that extends radially inward from the hub 284. The annular plate 291 may include an annular hub 293 that is attached to the outer ring 250 of the first bearing 240 such that first bearing 240 supports the first scroll member 276 and the driveshaft 246 for rotation about the first rotational axis A1. Rotation of the driveshaft 246 causes corresponding rotation of the first scroll member 76 about the rotational axis A1 of the driveshaft 246. That is, operation of the motor assembly 216 causes rotational of the driveshaft 246 and the first scroll member 276 together about the first rotational axis A1.

The hub 290 of the second scroll member 278 is rotatably supported by a third bearing 294 (a scroll bearing). As shown in FIG. 3, the third bearing 294 defines a third axis A3 that is offset from and parallel to the first and second axes A1, A2. The first and second scroll members 276, 278 may be coupled to each other by an Oldham coupling 296 or another type of rotation-synchronization device or mechanism. In the example shown in FIG. 3, the Oldham coupling 296 is coupled to the outer hub 284 and to the second end plate 286. The Oldham coupling 296 causes the second scroll member 278 to rotate about the third axis A3 while the first scroll member 276 rotates about the rotational axis A1.

The first and second spiral wraps 282, 288 are intermeshed with each other and cooperate to form a plurality of fluid pockets (i.e., compression pockets) therebetween. Rotation of the first scroll member 276 about the rotational axis A1 and rotation of the second scroll member 278 about the third axis A3 causes the fluid pockets to decrease in size as they move from a radially outer position to a radially inner position, thereby compressing the working fluid therein from the suction pressure to the discharge pressure.

The second end plate 286 may be disposed axially between the first end plate 280 and the annular plate 291. A first annular seal 297 and a second annular seal 298 may be attached to the annular plate 291 and may sealingly and slidably engage the second end plate 286 to form an annular biasing chamber 299 between the annular plate 291 and the second end plate 286. The first and second annular seals 297, 298 keep the biasing chamber 299 sealed off from the suction chamber 230 while still allowing relative movement between the first and second scroll members 276, 278. A biasing passage 300 may extend through the second end plate 286 and the hub 290 and may provide fluid communication between an intermediate-pressure compression pocket and the biasing chamber 299. In some configurations, instead of the first and second annular seals 297, 298 being attached to the annular plate 291 and slidably engaging the second end plate 286, the first and second annular seals 297, 298 could be attached to the second end plate 286 and slidably engaging the annular plate 291.

The first end plate 280 or the outer hub 284 may include a suction inlet opening (not shown) through which suction-pressure working fluid from the suction chamber 230 can be drawn into the compression mechanism 218. The first scroll member 276 may also include a discharge passage 304 that extends through the first end plate 280 and provides fluid communication between a radially innermost one of the fluid pockets and the discharge passage 262 of the driveshaft 246. A discharge valve 306 (e.g., a reed valve or other check valve) may be disposed within or adjacent the discharge passage 304. The discharge valve 306 allows working fluid to be discharged from the compression mechanism 218 through the discharge passage 304 and into the discharge passage 262 and prevents working fluid in the discharge passage 262 from flowing back into to the compression mechanism 218.

In some configurations, the first end plate 280 may include variable-volume-ratio (VVR) ports 308 and VVR valves 310 (e.g., reed valves or other check valves). The VVR valves 310 allow selective venting of radially intermediate fluid pockets to the discharge passage 262 when pressures within the radially intermediate fluid pockets rise above discharge pressure (i.e., the pressure of fluid within the discharge chamber 235).

The coupling 285 and the first end plate 280 cooperate to define a chamber 312 that is in fluid communication with the discharge passage 262 but fluidly isolated from the suction chamber 230. That is, the coupling 285 being in sealing contact with the driveshaft 246 and the first end plate 280 prevents fluid communication between the chamber 312 and the suction chamber 230. During rotation of the driveshaft 246, centrifugal force may cause the lubricant to collect in a radially outer portion of the chamber 312. Oil passages (not shown) in the first scroll member 276 and/or in the second scroll member 278 may direct lubricant from the chamber 312 to the Oldham coupling 296 and other parts of the scroll members 276, 278 that are subjected to friction.

As described above, the third bearing 294 supports the second scroll member 278 for rotation about the third axis A3. The third bearing 294 may be a rolling element bearing having an outer ring 314, an inner ring 316, and a plurality of rolling elements (e.g., spheres) 318 disposed between the outer and inner rings 314, 316. The outer ring 314 may be attached to the hub 290 of the second scroll member 278. The rolling elements 318 are encased between the outer and inner rings 314, 316.

The inner ring 316 of the third bearing 294 may be supported by the eccentric pin 244. The inner ring 316 may be in rolling contact with the eccentric pin 244 such that only a portion of the inner diametrical surface of the inner ring 316 is in contact with the eccentric pin 244 at any given time. FIG. 3 shows a first portion of the inner diametrical surface of the inner ring 316 in contact with one side of the eccentric pin 244 and a clearance gap 320 between the opposite side of the eccentric pin 244 and a second portion of the inner diametrical surface of the inner ring 316.

Since the inner ring 316 is allowed to roll along the eccentric pin 244, the second scroll member 278 is also allowed to roll with the third bearing 294 along the eccentric pin 244. This allows the second scroll member 278 to be radially compliant relative to the first scroll member 276. Rolling along the eccentric pin 244 allows for appropriate radial compliance independent of operating speed.

Figure 5:
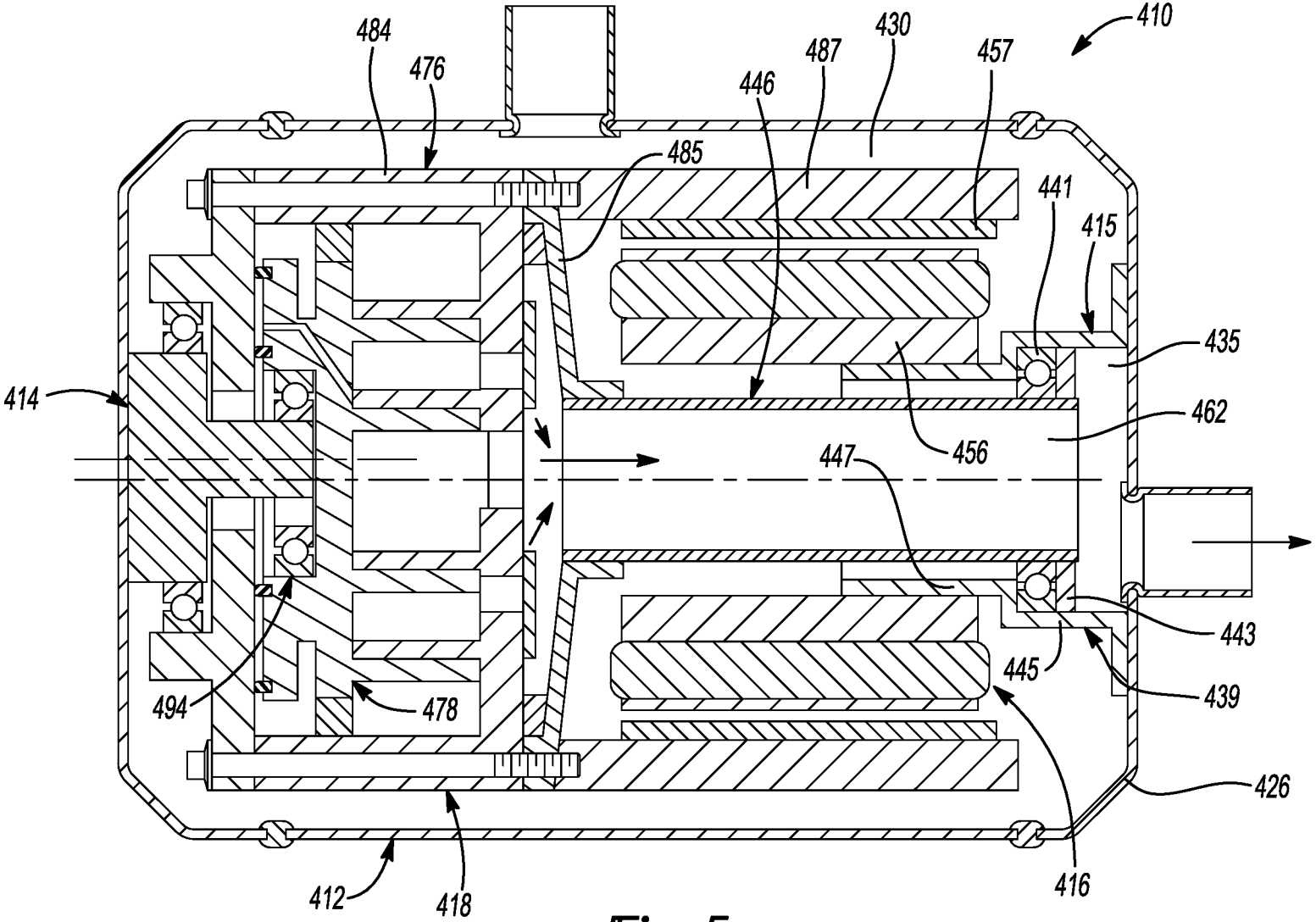
FIG. 5 is a cross-sectional view of yet another compressor according to the principles of the present disclosure.

Referring now to FIG. 5, another compressor 410 is provided that may include a hermetic shell assembly 412, a first bearing support assembly (or bearing housing assembly) 414, a second bearing support assembly (or bearing housing assembly) 415, a motor assembly 416, a compression mechanism 418, and a third bearing 494 (a scroll bearing—i.e., a bearing supporting a second scroll member 478 of the compression mechanism 418). The structure and function of the shell assembly 412, first and second bearing support assemblies 414, 415, the third bearing 494, and the compression mechanism 418 may be similar or identical to the shell assembly 212, first and second bearing support assemblies 214, 215, the third bearing 294, and the compression mechanism 218 described above (apart from any differences described below), and therefore, similar features will not be described again in detail.

The second bearing support assembly 415 may be fixed to the shell assembly 412 (e.g., to a second end cap 426) and may include a second bearing support member (or bearing housing) 439 and a second bearing 441. The second bearing support member 439 may house the second bearing 441 therein. An annular seal 443 may sealingly engage the second bearing support member 439 and driveshaft 446 and may separate a suction chamber 430 from a discharge chamber 435 (i.e., forming a partition preventing fluid communication between the suction chamber 430 and the discharge chamber 435).

The second bearing support member 439 may be an annular member having a bearing support portion 445 and a motor support portion 447. A portion of the driveshaft 446 extends into the second bearing support member 439 (i.e., through the motor support portion 447 and into the bearing support portion 445 where the second bearing 441 supports the driveshaft 446). The seal 443 may also be disposed within the bearing support portion 445 and cooperates with the bearing support portion 445 and the end cap 426 to define the discharge chamber 435. In this manner, the overall volume of the discharge chamber 435 can be reduced, as discharge gas can flow through the discharge passage 462 (like discharge passage 262) in the driveshaft 446 and into the discharge chamber 435.

The motor assembly 416 may include a stator 456 and rotor magnets 457 attached to an inner diametrical surface of a rotor ring 487. The stator 456 may be fixed attached to the motor support portion 447 of the second bearing support member 439. The stator 456 may be disposed radially inward relative to the rotor magnets 457 and the rotor ring 487 (i.e., the rotor magnets 457 and rotor ring 487 surround the stator 456). An axial end of an outer hub 484 of a first scroll member 476 may be fixedly attached to a coupling 485 (which is fixedly attached to the driveshaft 446). The rotor ring 487 may extend axially from the coupling 485 and may fixedly engage the rotor magnets 457.

Figure 6:
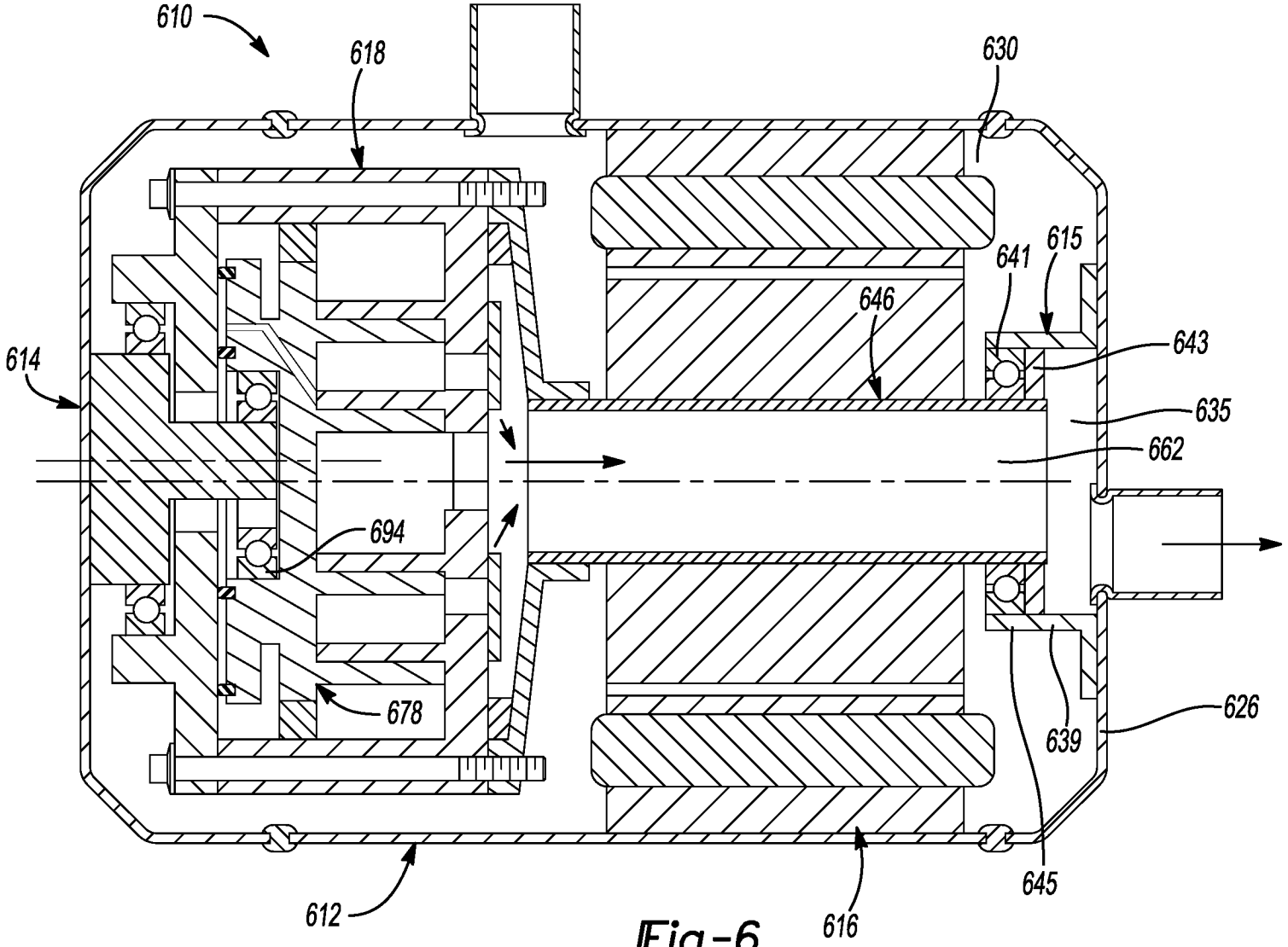
FIG. 6 is a cross-sectional view of still another compressor according to the principles of the present disclosure.

Referring now to FIG. 6, another compressor 610 is provided that may include a hermetic shell assembly 612, a first bearing support assembly (or bearing housing assembly) 614, a second bearing support assembly (or bearing housing assembly) 615, a motor assembly 616, a compression mechanism 618, and a third bearing 694 (a scroll bearing—i.e., a bearing supporting a scroll member 678 of the compression mechanism 618). The structure and function of the shell assembly 612, first bearing support assembly 614, second bearing support 615, the third bearing 694, the motor assembly 616 and the compression mechanism 618 may be similar or identical to the shell assembly 212, first bearing support assembly 214, second bearing support assembly 415, the third bearing 294, the motor assembly 216, and the compression mechanism 218 described above (apart from any differences described below), and therefore, similar features will not be described again in detail.

The second bearing support assembly 615 may include a second bearing support member (or bearing housing) 639 and a second bearing 641. The second bearing support member 639 may be fixed to the shell assembly 612 (e.g., to a second end cap 626) and may house the second bearing 641 therein. An annular seal 643 may sealingly engage the second bearing support member 639 and driveshaft 646 and may separate a suction chamber 630 from a discharge chamber 635 (i.e., forming a partition preventing fluid communication between the suction chamber 630 and the discharge chamber 635).

Like the second bearing support member 439, the second bearing support member 639 may be an annular member having a bearing support portion 645. Unlike the second bearing support member 439, however, the second bearing support member 639 does not include a motor support portion. A portion of the driveshaft 646 extends into the second bearing support member 639 (i.e., into the bearing support portion 645 where the second bearing 641 supports the driveshaft 646). The seal 643 may also be disposed within the bearing support portion 645 and cooperates with the second bearing support member 639 and the end cap 626 to define the discharge chamber 635. In this manner, the overall volume of the discharge chamber 635 can be reduced, as discharge gas can flow through the discharge passage 662 (like discharge passage 262) in the driveshaft 646 and into the discharge chamber 635.

Figure 7:
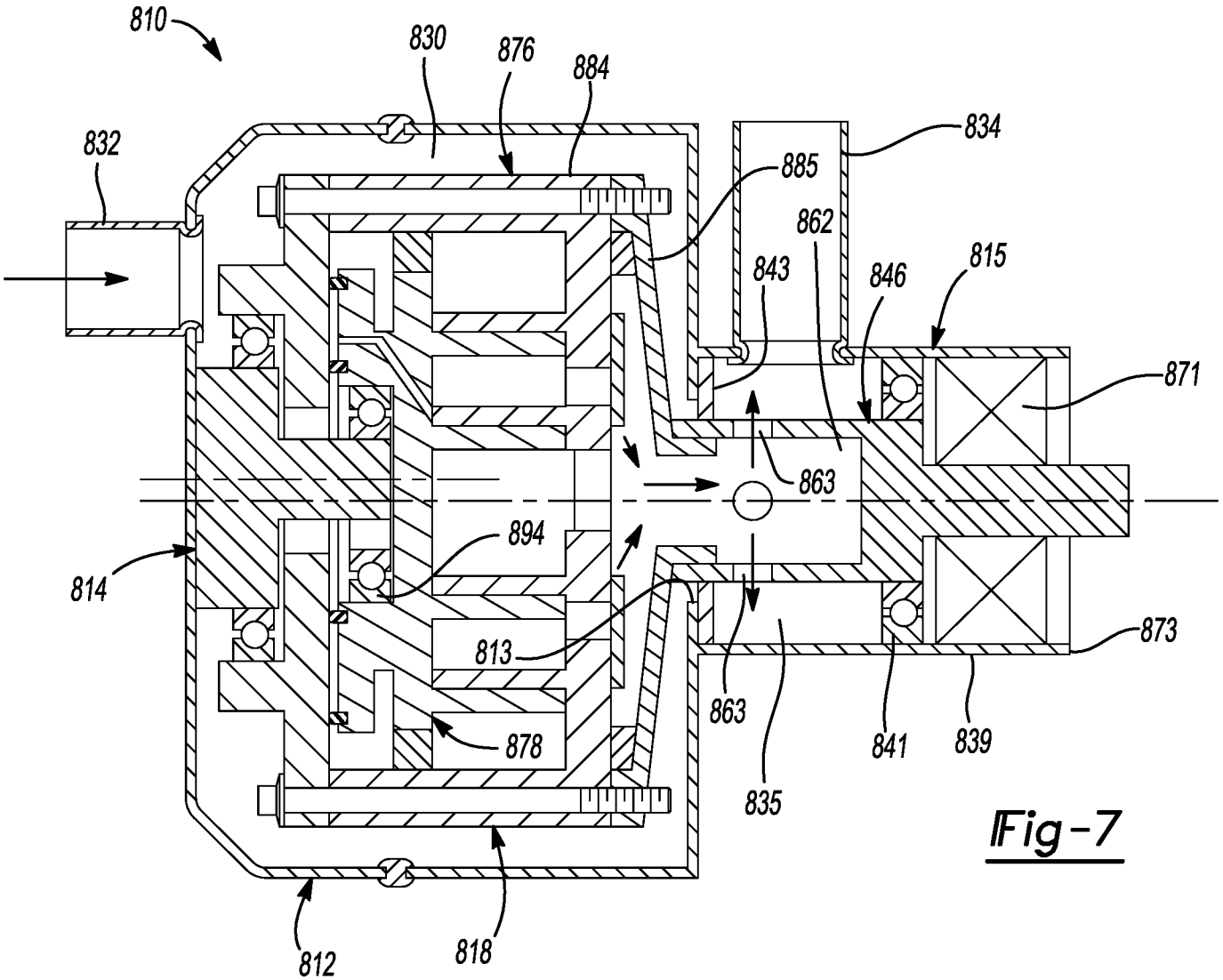
FIG. 7 is a cross-sectional view of still another compressor according to the principles of the present disclosure.

Referring now to FIG. 7, another compressor 810 is provided that may include a hermetic shell assembly 812, a first bearing support assembly (or bearing housing assembly) 814, a second bearing support assembly (or bearing housing assembly) 815, a compression mechanism 818, and a third bearing 894 (a scroll bearing—i.e., a bearing supporting a second scroll member 878 of the compression mechanism 818). The structure and function of the shell assembly 812, first bearing support assembly 814, third bearing 894, and the compression mechanism 818 may be similar or identical to the shell assembly 212, first bearing support assembly 214, second bearing support assembly 215, third bearing 294, and the compression mechanism 218 described above (apart from any differences described below and/or shown in the figures), and therefore, similar features will not be described again in detail. The compressor 810 is an open-drive compressor. That is, the compressor 810 does not include a motor, but rather, is connectable to an external power source such as an engine or external motor, for example.

The shell assembly 812 may define a suction chamber 830 in which the first bearing support assembly 814, third bearing 894, and compression mechanism 818 may be disposed. A suction gas inlet fitting 832 may be attached to the shell assembly 812 to allow suction-pressure working fluid (i.e., low-pressure working fluid) to enter the suction chamber 830 for subsequent compression in the compression mechanism 818.

An axial end of an outer hub 884 of a first scroll member 876 may be fixedly attached to a coupling 885. The coupling 885 may be attached to a driveshaft 846, which may extend into the suction chamber 830 through an opening 813 in the shell assembly 812. A first end of the driveshaft 846 may include a discharge passage 862 that receives compressed working fluid from the compression mechanism 818.

The second bearing support assembly 815 may include a second bearing support member (or bearing housing) 839 and a second bearing 841. The second bearing support member 839 may be an annular member that is fixed to or integrally formed with the shell assembly 812 and houses the second bearing 841 therein. The second bearing support member 839 may define a discharge chamber 835. An annular seal 843 may sealingly engage the second bearing support member 839, the driveshaft 846 and the shell assembly 812 and may separate the suction chamber 830 from the discharge chamber 835 (i.e., forming a partition preventing fluid communication between the suction chamber 830 and the discharge chamber 835).

The driveshaft 846 extends at least partially through the second bearing support member 839 and may include one or more radially extending apertures 863 through which compressed working fluid flows from the discharge passage 862 to the discharge chamber 835. A discharge gas outlet fitting 834 may be attached to the second bearing support member 839. Compressed working fluid in the discharge chamber 835 may exit the compressor 810 through the discharge gas outlet fitting 834.

An annular seal 871 may be disposed within the second bearing support member 839 and may sealingly engage the driveshaft 846 and an inner diametrical surface of the second bearing support member 839. The seal 871 may cooperate with the seal 843 and the second bearing support member 839 to define the discharge chamber 835. A portion of the driveshaft 846 extends through the seal 871 and may extend out of an open axial end 873 of the second bearing support member 839. An external power source (e.g., an engine or external motor) can be connected to the end of the driveshaft 846 that extends through the open axial end 873 of the second bearing support member 839.

Figure 8:
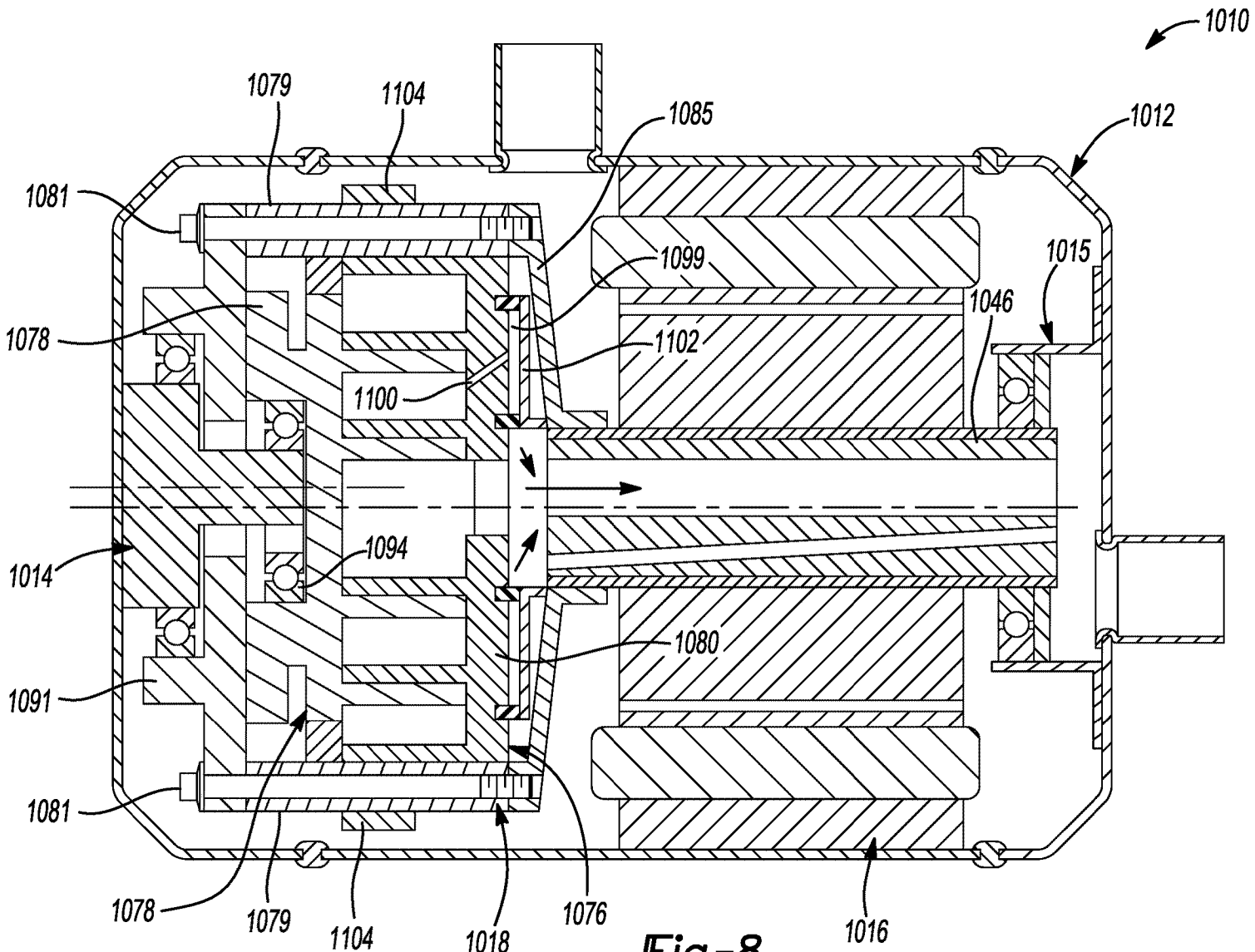
FIG. 8 is a cross-sectional view of still another compressor according to the principles of the present disclosure.

Referring now to FIG. 8, another compressor 1010 is provided that may include a hermetic shell assembly 1012, a first bearing support assembly (or bearing housing assembly) 1014, a second bearing support assembly (or bearing housing assembly) 1015, a motor assembly 1016, a compression mechanism 1018, and a third bearing 1094 (a scroll bearing—i.e., a bearing supporting a second scroll member 1078 of the compression mechanism 1018). The structure and function of the shell assembly 1012, first bearing support assembly 1014, third bearing 1094, motor assembly 1016, and the compression mechanism 1018 may be similar or identical to the shell assembly 212, 612 first bearing support assembly 214, 614, second bearing support assembly 215, 615, third bearing 294, 694, motor assembly 216, 616, and the compression mechanism 218, 618 described above (apart from any differences described below and/or shown in the figures), and therefore, similar features will not be described again in detail.

The compression mechanism 1018 includes a first scroll member 1076 and the second scroll member 1078. The first scroll member 1076 may be mounted to a plurality of sleeve guides 1079 (e.g., generally tubular members) in a manner that allows the first scroll member 1076 to slide in an axial direction along the lengths of the sleeve guides 1079. A plurality of fasteners 1081 may extend through annular plate 1091 and the sleeve guides 1079 and may threadably engage coupling 1085. In this manner, the coupling 1085, sleeve guides 1079, the first scroll member 1076 and the annular plate 1091 all rotate together with driveshaft 1046. The second scroll member 1078 is slidably supported by the annular plate 1091 such that the annular plate 1091 forms a thrust bearing for the second scroll member 1078.

While the compressors 210, 610 are shown in the figures having the biasing chamber 299 partially defined by the end plate 286 of the second scroll member 276 and a biasing passage 300 extending through the end plate 286, the compressor 1010 includes a biasing passage 1100 extending through an end plate 1080 of the first scroll member 1076 and a biasing chamber 1099 partially defined by the end plate 1080. An annular floating seal 1102 may sealingly engage the end plate 1080 and the coupling 1085 and may cooperate with the end plate 1080 to define the biasing chamber 1099. The first scroll member 1076 may include one or more flanges 1104 that slidably engage the sleeve guides 1079 to allow the first scroll member 1076 to move axially relative to the second scroll member 1078 and the coupling 1085. In this manner, intermediate-pressure working fluid from an intermediate compression pocket can flow into the biasing chamber 1099 (via the biasing passage 1100) and axially bias the first scroll member 1076 toward the second scroll member 1078.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly;

a compression mechanism disposed within the shell assembly and including a first compression member and a second compression member that cooperate to form a compression pocket therebetween;

a driveshaft coupled to the first compression member and configured to rotate the first compression member relative to the second compression member;

a first bearing supporting the driveshaft for rotation about a first axis;

a second bearing spaced apart from the first bearing and supporting the driveshaft for rotation about the first axis;

a third bearing spaced apart from the first and second bearings and defining a second axis, wherein the third bearing supports the second compression member for rotation relative to the first compression member about the second axis; and a surface supporting the third bearing relative to the shell assembly, wherein the third bearing is in rolling contact with the surface such that the entire third bearing is able to roll along the surface to move the second compression member and the second axis in a radial direction relative to the first compression member.

2. The compressor of claim 1, wherein the surface is fixed relative to the shell assembly.

3. The compressor of claim 2, wherein the surface is integrally formed with the shell assembly.

4. The compressor of claim 2, wherein the surface is a flat surface.

5. The compressor of claim 4, wherein the surface supports an outer periphery of the third bearing such that the outer periphery is in rolling contact with the surface.

6. The compressor of claim 2, wherein the surface is a round surface.

7. The compressor of claim 6, wherein the surface supports an inner periphery of the third bearing such that the inner periphery is in rolling contact with the surface.

8. The compressor of claim 6, wherein the surface defines a third axis that is parallel to and spaced apart from the second axis.

9. The compressor of claim 1, wherein the first compression member includes an outer hub that surrounds the second compression member, and wherein the outer hub is attached to the driveshaft.

10. The compressor of claim 1, wherein the driveshaft includes a discharge passage through which compressed working fluid is transmitted from the compression mechanism to a discharge chamber defined by the shell assembly.

11. A compressor comprising:

a shell assembly;

a first scroll member disposed within the shell assembly and rotatable relative to the shell assembly about a first axis;

a second scroll member disposed within the shell assembly and rotatable relative to the shell assembly about a second axis that is parallel to and spaced apart from the first axis, wherein the first and second scroll members cooperate to form a compression pocket therebetween;

a driveshaft coupled to the first scroll member and configured to rotate the first scroll member about the first axis;

a first bearing supporting the driveshaft for rotation about the first axis;

a scroll bearing spaced apart from the first bearing and defining the second axis, wherein the scroll bearing supports the second scroll member for rotation relative to the first scroll member about the second axis; and a surface supporting the scroll bearing relative to the shell assembly, wherein the scroll bearing is in rolling contact with the surface such that the entire scroll bearing is able to roll along the surface to move the second scroll member and the second axis in a radial direction relative to the first scroll member.

12. The compressor of claim 11, wherein the surface is fixed relative to the shell assembly.

13. The compressor of claim 12, wherein the surface is integrally formed with the shell assembly.

14. The compressor of claim 11, wherein the surface is a flat surface.

15. The compressor of claim 14, wherein the surface supports an outer periphery of the scroll bearing such that the outer periphery is in rolling contact with the surface.

16. The compressor of claim 11, wherein the surface is a round surface.

17. The compressor of claim 16, wherein the surface supports an inner periphery of the scroll bearing such that the inner periphery is in rolling contact with the surface.

18. The compressor of claim 16, wherein the surface defines a third axis that is parallel to and spaced apart from the second axis.

19. The compressor of claim 11, wherein the first scroll member includes an outer hub that surrounds the second scroll member, and wherein the outer hub is attached to the driveshaft.

20. The compressor of claim 11, wherein the driveshaft includes a discharge passage through which compressed working fluid is transmitted to a discharge chamber defined by the shell assembly.

* * * * *